US007322852B2

(12) United States Patent
Nagata et al.

(10) Patent No.: US 7,322,852 B2
(45) Date of Patent: Jan. 29, 2008

(54) CONNECTOR AND ELECTRONIC DEVICE EQUIPPED WITH THE SAME

(75) Inventors: Takayuki Nagata, Yao (JP); Akihito Shichida, Yao (JP); Hayato Kondo, Yao (JP)

(73) Assignee: Hosiden Corporation, Yao-shi (JP)

( * ) Notice: Subject to any disclaimer, the term of this patent is extended or adjusted under 35 U.S.C. 154(b) by 0 days.

(21) Appl. No.: 11/606,975

(22) Filed: Dec. 1, 2006

(65) Prior Publication Data

US 2007/0141909 A1 Jun. 21, 2007

(30) Foreign Application Priority Data

Dec. 21, 2005 (JP) ..... 2005-368850

(51) Int. Cl.
*H01R 9/05* (2006.01)

(52) U.S. Cl. ..... 439/579; 439/497

(58) Field of Classification Search ..... 439/492, 439/497, 499, 579, 736, 874
See application file for complete search history.

(56) References Cited

U.S. PATENT DOCUMENTS 6,793,527 B2 * 9/2004 Noro ..... 439/579
6,913,485 B2 * 7/2005 Ko ..... 439/579
7,189,105 B2 * 3/2007 Takaku et al. ..... 439/497
7,192,301 B2 * 3/2007 Kuroda et al. ..... 439/497

FOREIGN PATENT DOCUMENTS

JP 2001-307556 11/2001
JP 2005-116447 4/2005

* cited by examiner

*Primary Examiner*—Thanh-Tam Le
(74) *Attorney, Agent, or Firm*—Kratz, Quintos & Hanson, LLP

(57) ABSTRACT

An object of the present invention is to provide a connector not requiring a ground bar and having high shielding property, and an electronic device equipped with the same. The connector is for connection to a cable group comprising a plurality of coaxial cables which are integrated by aligning the cables in parallel and connecting shielding conductors thereof to a conductor part. The connector has a plurality of terminal units electrically connected to connecting conductors 11*a* of the plurality of coaxial cables, a body in which the plurality of terminal units are aligned in a length direction, a shield member attached to the body and positioned between the terminal units and the conductor part, and a shield cover attached to the body for sandwiching the conductor part of the cable group with the shield member.

9 Claims, 7 Drawing Sheets

CONNECTOR AND ELECTRONIC DEVICE EQUIPPED WITH THE SAME

The present application claims priority under 35 U.S.C. § 119 of Japanese Patent Application No. 2005-368850 filed on Dec. 21, 2005, the disclosure of which is expressly incorporated by reference herein in its entity.

BACKGROUND OF THE INVENTION

1. Field of the Invention

The present invention relates to a connector to which cables such as coaxial cables are connected, and an electronic device equipped with the same.

2. Description of the Related Art

Recently, in electric devices such as personal computers, portable telephones, and portable mobile terminal devices such as PDA, extra fine coaxial cables are used for increasing signal speeds between respective parts of an electronic device, as connecting parts between them.

These coaxial cables are used in such a manner that a plurality of cables are aligned in parallel, and the exposed outer conductors are connected by soldering to be integrated (see Japanese Patent Laid-Open Publication No. 2001-307556). Specifically, a ground bar is connected to the solder part in which a plurality of coaxial cables are integrated, which is used such that the ground bar is electrically connected to a shield member of a connector and the inner conductors of the coaxial cables are electrically connected to a terminal part of the connector.

However, when connecting the coaxial cables to the connector, assembling the ground bar into the connector is very bothersome. Further, since the number of parts increases, a problem of cost increase is caused.

As a connector capable of solving such a problem, there is one in which a solder part integrating a plurality of coaxial cables is connected by soldering to a shield cover (see embodiment 3 and FIG. 4 of Japanese Patent Laid-Open Publication No. 2005-116447).

However, in the connector, only the upper sides of the coaxial cables are shielded with the shield cover, so it contains another problem of the shielding property being low.

SUMMARY OF THE INVENTION

The present invention is in view of the situation described above, and an object thereof is to provide a connector not requiring a ground bar and having high shielding property, and an electronic device equipped with the same.

In order to achieve the object, a connector of the present invention is a connector for connection to a cable group comprising a plurality of cables, the cables being integrated by aligning the cables in parallel and connecting shielding conductors thereof to a conductor part, the connector including a plurality of terminal units for electrical connection to connecting conductors of the plurality of cables, a body having an insulating property in which the plurality of terminal units are aligned in a length direction, a shield member provided to the body and positioned between the plurality of terminal units and the conductor part; and a shield cover attached to the body for sandwiching the conductor part with the shield member.

Another connector of the present invention is a connector for connection to a cable group comprising a plurality of cables, the cables being aligned in parallel and having shielding conductors for shielding the whole of the cables, the shielding conductors connected to a conductor part, the connector including a plurality of terminal units for electrical connection to connecting conductors of the plurality of cables, a body having insulating property in which the plurality of terminal units are aligned in a length direction, a shield member provided to the body and positioned between the plurality of terminal units and the conductor part, and a shield cover attached to the body for sandwiching the conductor part with the shield member.

It is preferable that at least one of the shield member and the shield cover be connected by soldering to the conductor part.

If the shield cover is connected by soldering to the conductor part of the cable group, it is preferable that the portion of the shield cover contacting the conductor part be provided with piece members for connecting by soldering to the conductor part.

In each of the terminal units, the top end part may be exposed from one widthwise end portion of the top surface of the body so as to be connectable to the connecting conductors of the cables, and the bottom end part may be exposed from the other widthwise end side of the bottom face of the body. In this case, the shield member is a frame to be mounted to the body, including a first shield piece having an almost inverted L shape in a cross-sectional view and extending along the other widthwise end portion of the top surface of the body and the other widthwise end face of the body, and a second shield piece extending along one widthwise side face of the body. A portion of the first shield piece contacting the top surface of the body is adapted to contact the conductor part.

In the case of the connector according to the present invention, the conductor part of the cable group is adapted to be sandwiched between the shield member provided to the body and positioned between the terminal units and the conductor part, and the shield cover mounted on the body, so a ground bar is not needed. Therefore, the cost of parts and the assembling cost of the ground bar can be reduced, so that a lower cost can be realized. Further, since the ground bar is not needed, the height of the device can be reduced. Moreover, since the shield member is positioned between the terminal units and the conductor parts of the cable group, signals leaked from the shielding conductors of the cable group can be shielded so as not to be absorbed by the adjacent terminal units. Thereby, it is possible to prevent crosstalk caused by the signals being absorbed by the adjacent terminal units. Further, since the conductor part of the cable group is sandwiched between the shield member and the shield cover, it is possible to shield signals leaked from the shielding conductors of the cable group so as not to affect the respective parts of an electronic device on which the connector is mounted. Therefore, the connector can have higher shielding property compared with the conventional examples.

In the case of the connector according to the present invention, at least one of the shield member and the shield cover is connected by soldering to the conductor part, so drop-off of the cable group can be prevented preferably. In particular, if both of the shield member and the shield cover connected to the conductor part of the cable group, the holding force of the cable group can be improved. Therefore, even if the cable group is drawn upward, disconnection of the solder connected part or solder separation between the connecting conductors of the cable group and the terminal units can be prevented.

In the case of the connector according to the present invention, the portion of the shield cover contacting the conductor part, is provided with a piece member. Therefore, by connecting the piece member to the conductor part by soldering, solder-connection can be performed easily.

In the case of the connector according the present invention, the first shield piece of the shield member is in an almost inverted L shape in a cross-sectional view and extends along the other widthwise end portion of the top surface of the body and along the other widthwise end face of the body, and is adapted such that a portion thereof contacting the top surface of the body contacts the conductor part. Therefore, the first shield piece is positioned between the lower end portions of the terminal units incorporated under the other widthwise end portion of the top surface of the body and the conductor part so as to shield the lower end portions of the terminal units, and also is able to shield the other widthwise end face of the body. Further, the second shield piece of the shield member extends along one-widthwise side of the body, so it can shield this one side. In this way, not only a part between the terminal units and the conductor part of the cable group but also the both widthwise side faces of the body can be shielded, so the connector having much higher shielding property can be realized.

In the case of an electronic device according to the present invention, the same effects as those of the above-described connector can be achieved.

DETAILED DESCRIPTION OF THE PREFERRED EMBODIMENT

Figure 1:
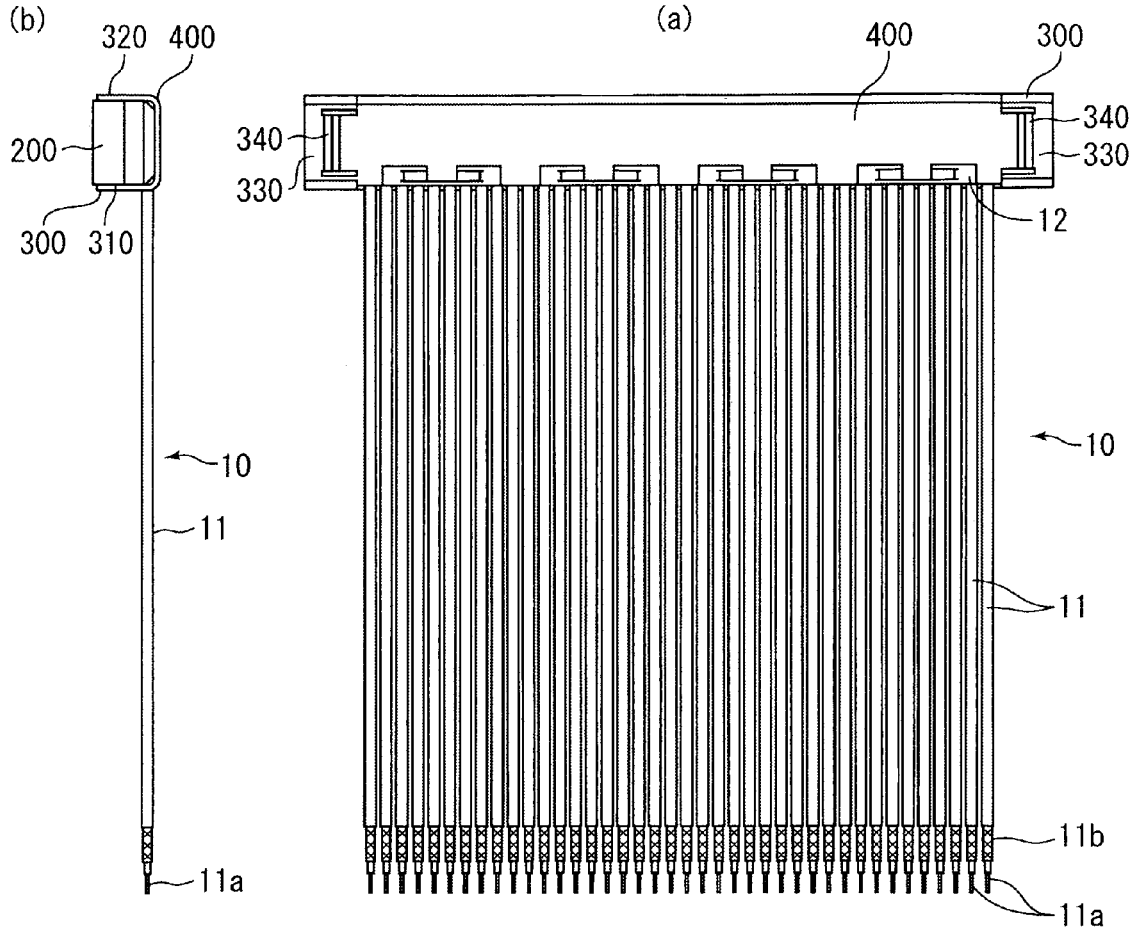
FIG. 1 is a diagram showing a used state of a connector according to an embodiment of the present invention, in which (a) is a plan view and (b) is a side view.
Figure 2:
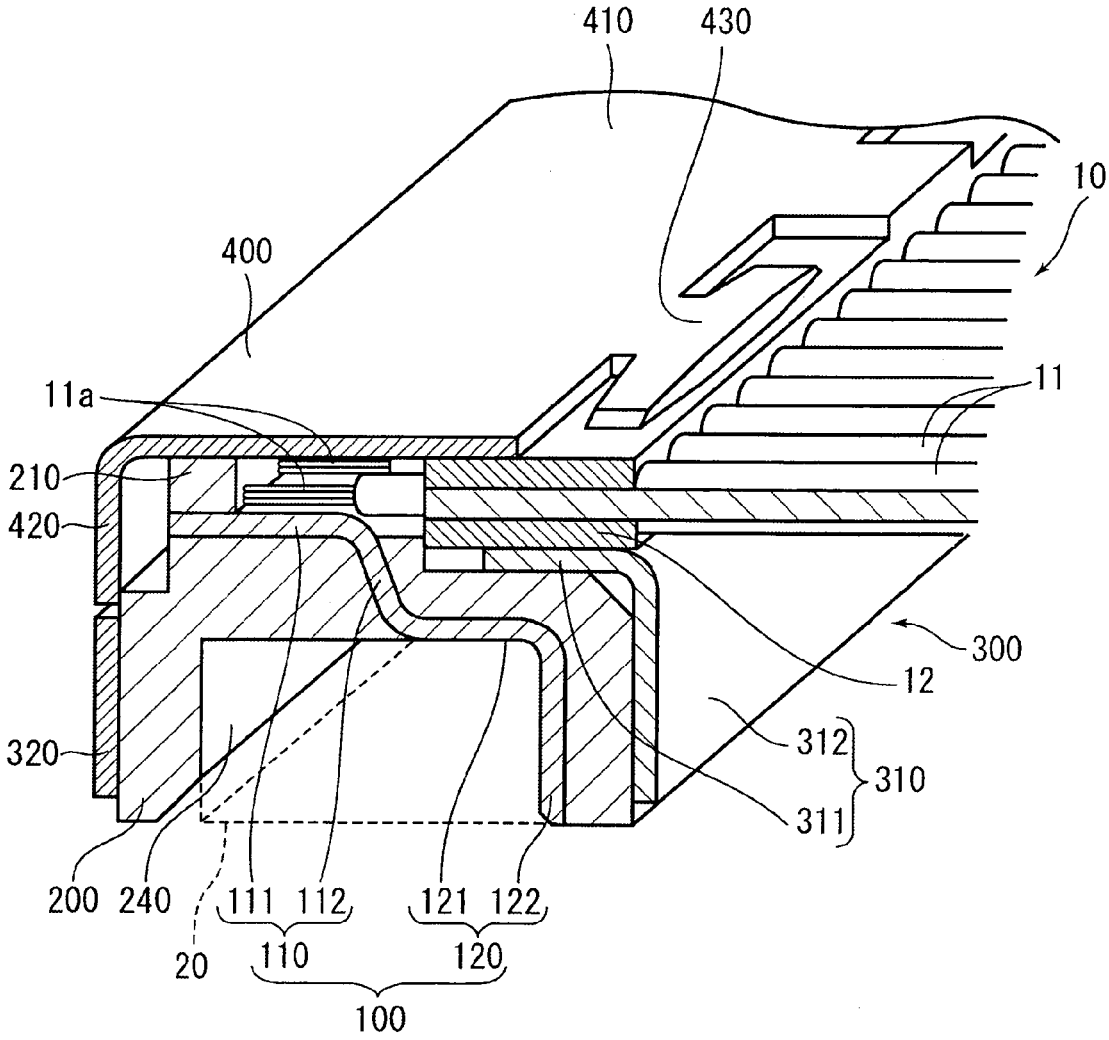
FIG. 2 is a schematic sectional perspective view showing a used state of the connector.
Figure 3:
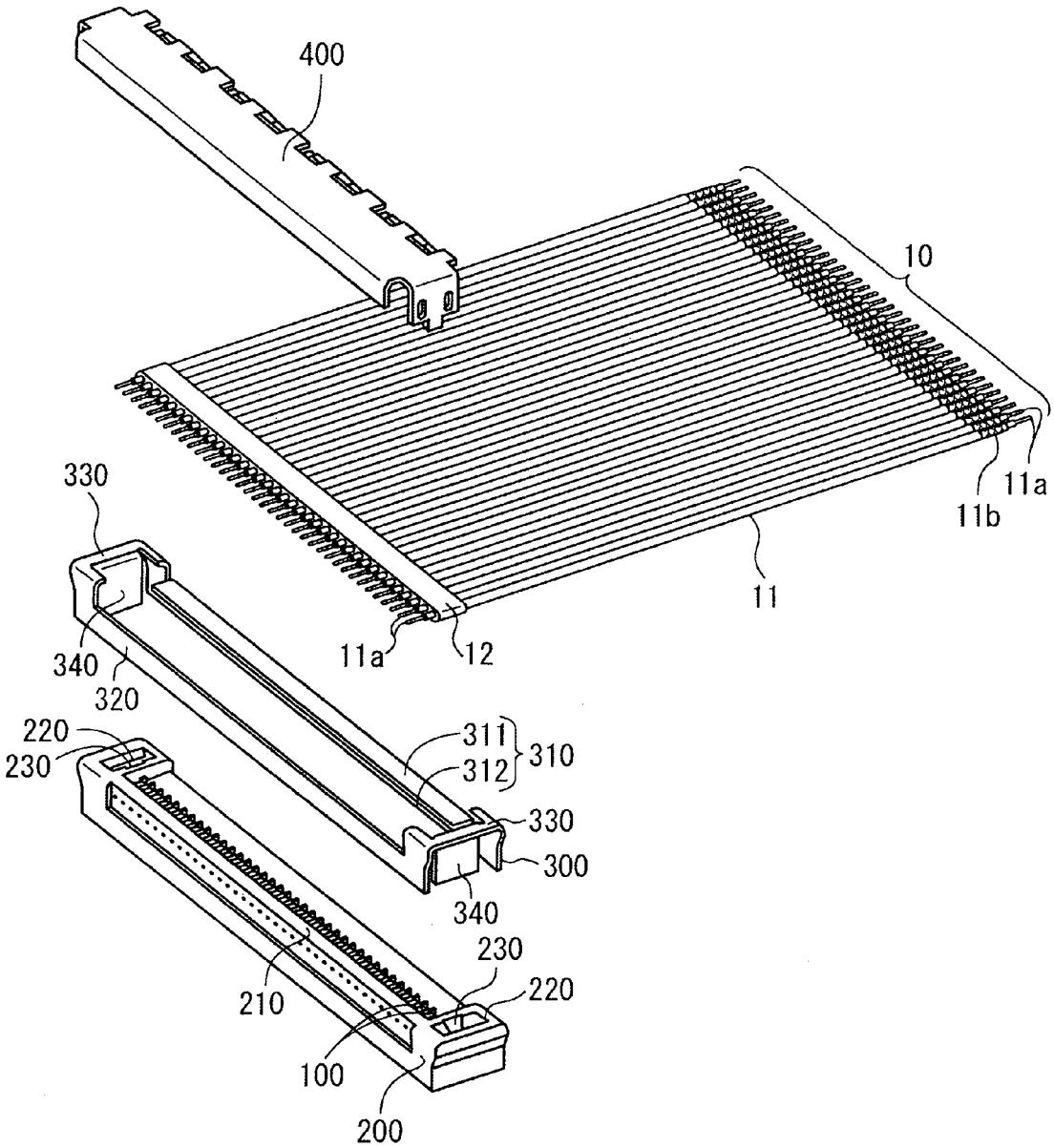
FIG. 3 is a schematic exploded perspective view of the connector.
Figure 4:
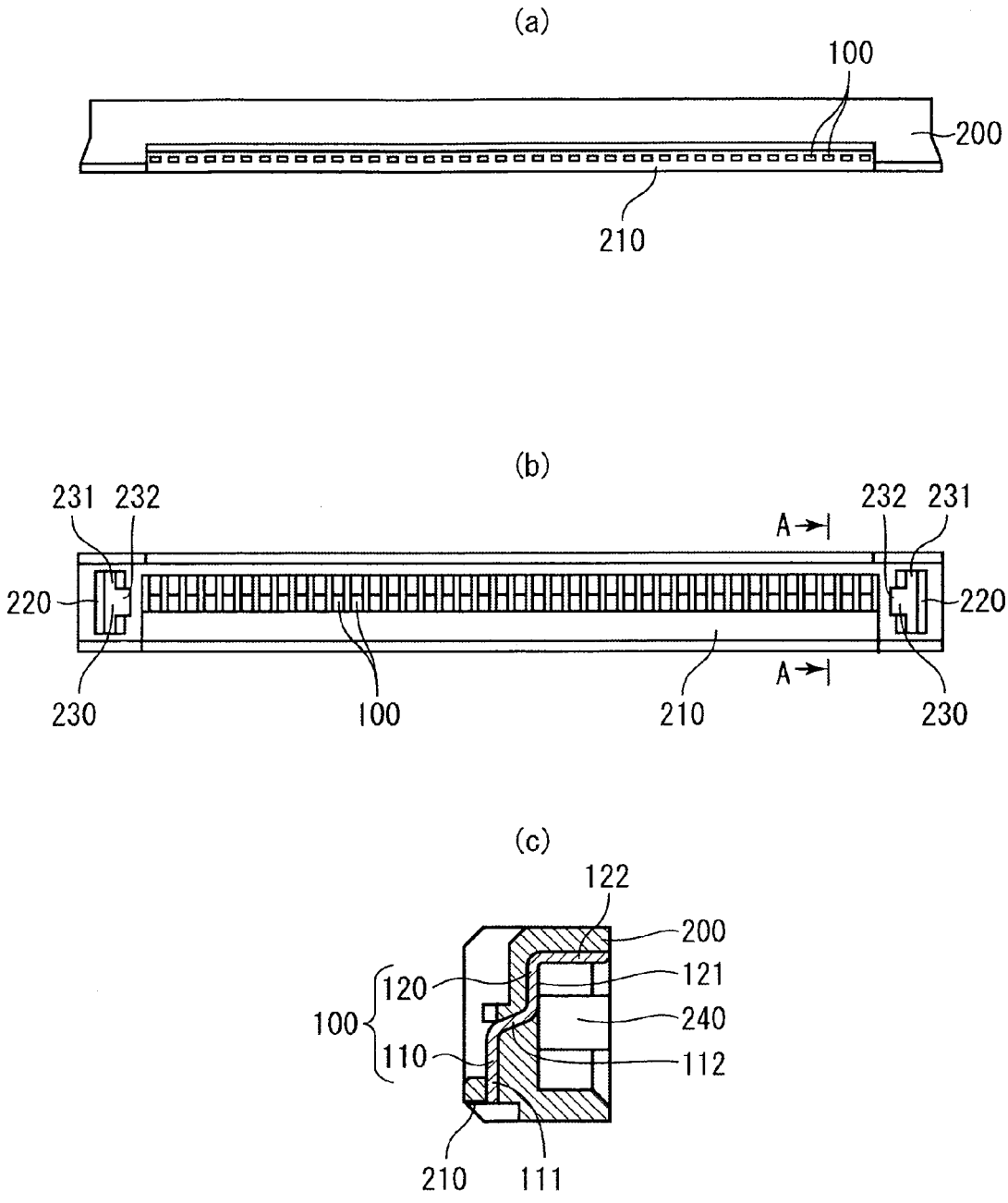
FIG. 4 is a diagram showing the body to which terminal units of the connector are provided, in which (a) is a front view, (b) is a plan view and (c) is an A-A sectional view.
Figure 5:
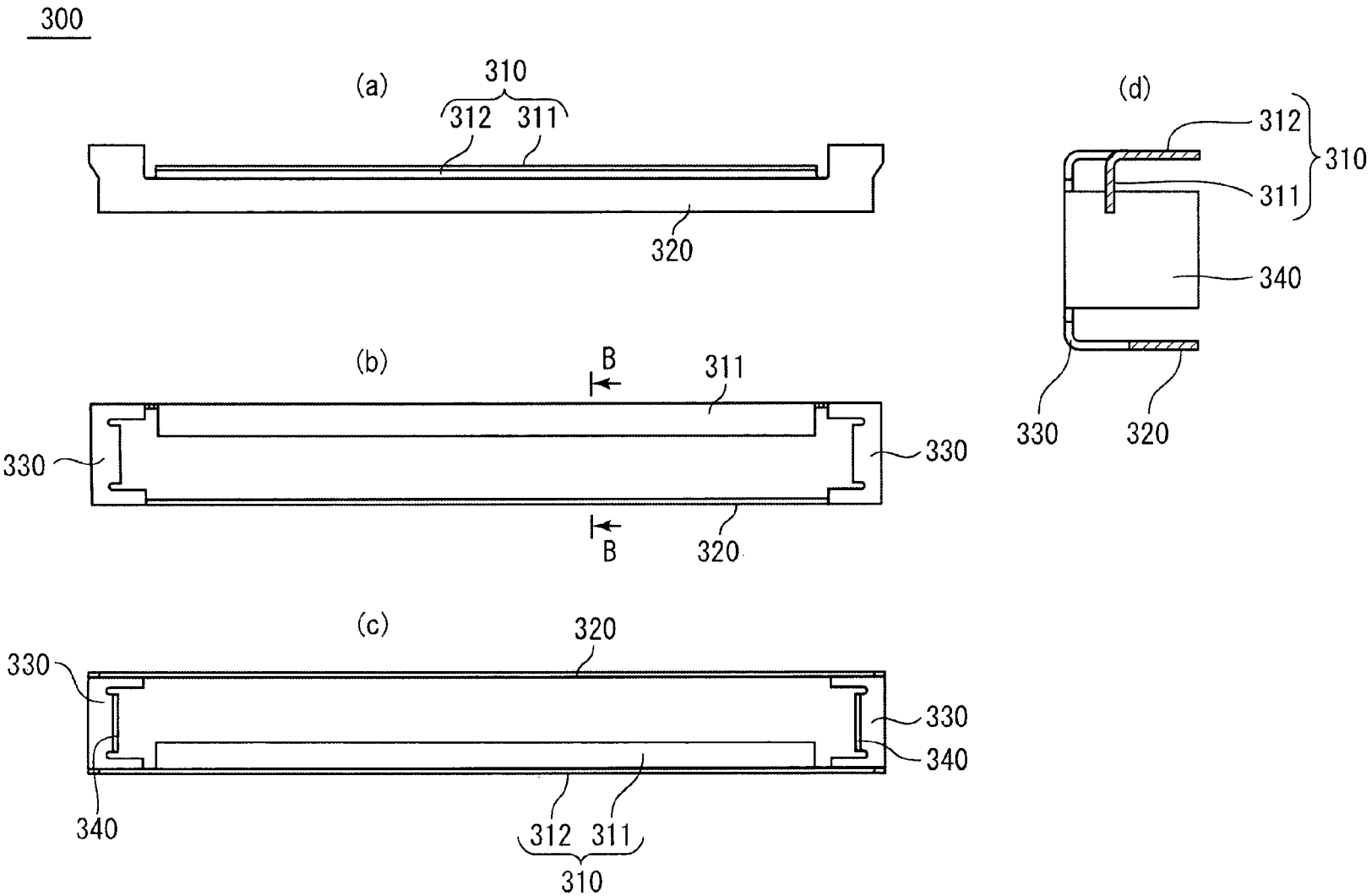
FIG. 5 is a diagram showing a shield member of the connector, in which (a) is a front view, (b) is a plan view, (c) is a bottom view, and (d) is a B-B sectional view.
Figure 6:
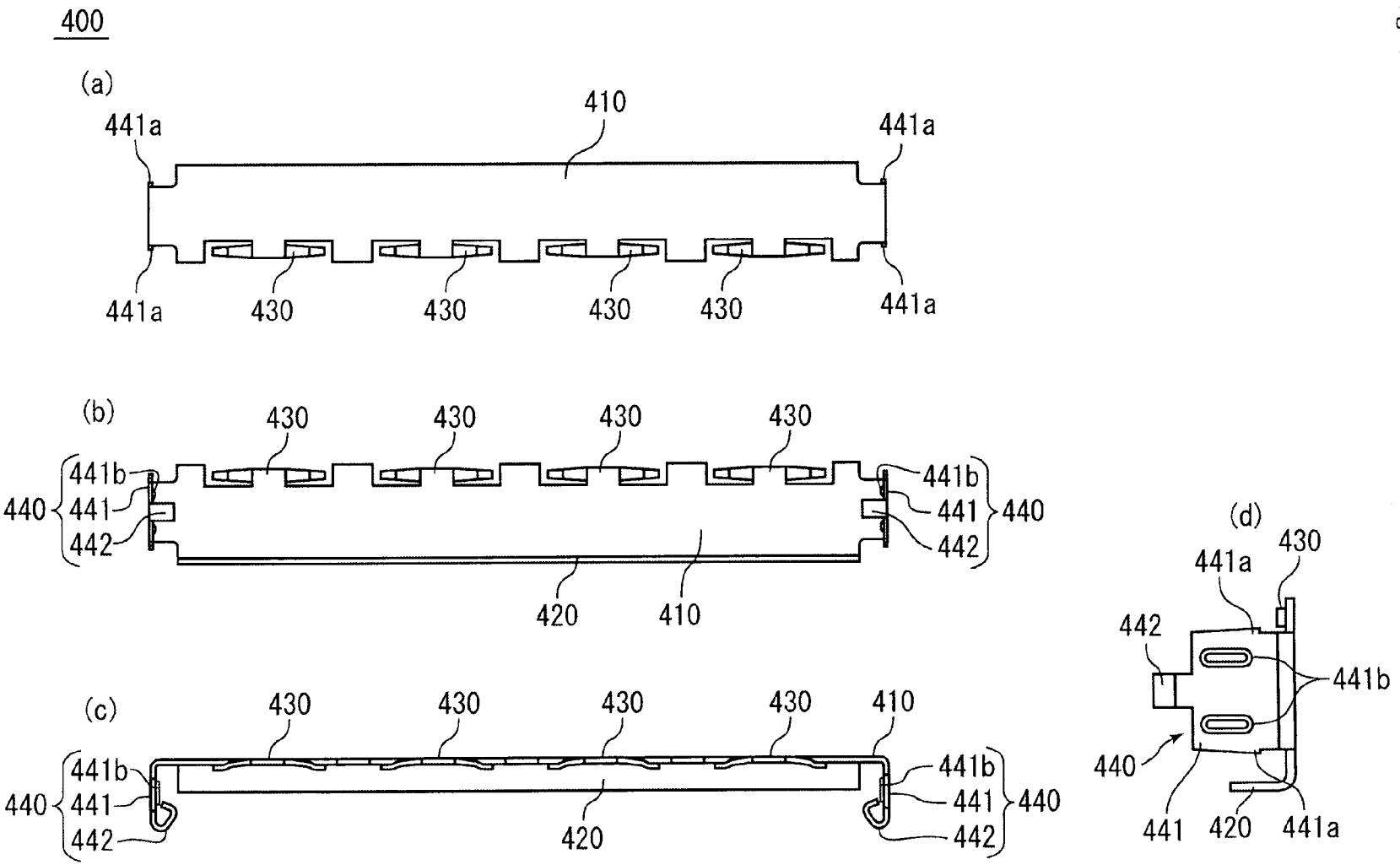
FIG. 6 is a diagram showing a shield cover of the connector, in which (a) is a plan view, (b) is a bottom view, (c) is a back view, and (d) is a side view.
Figure 7:
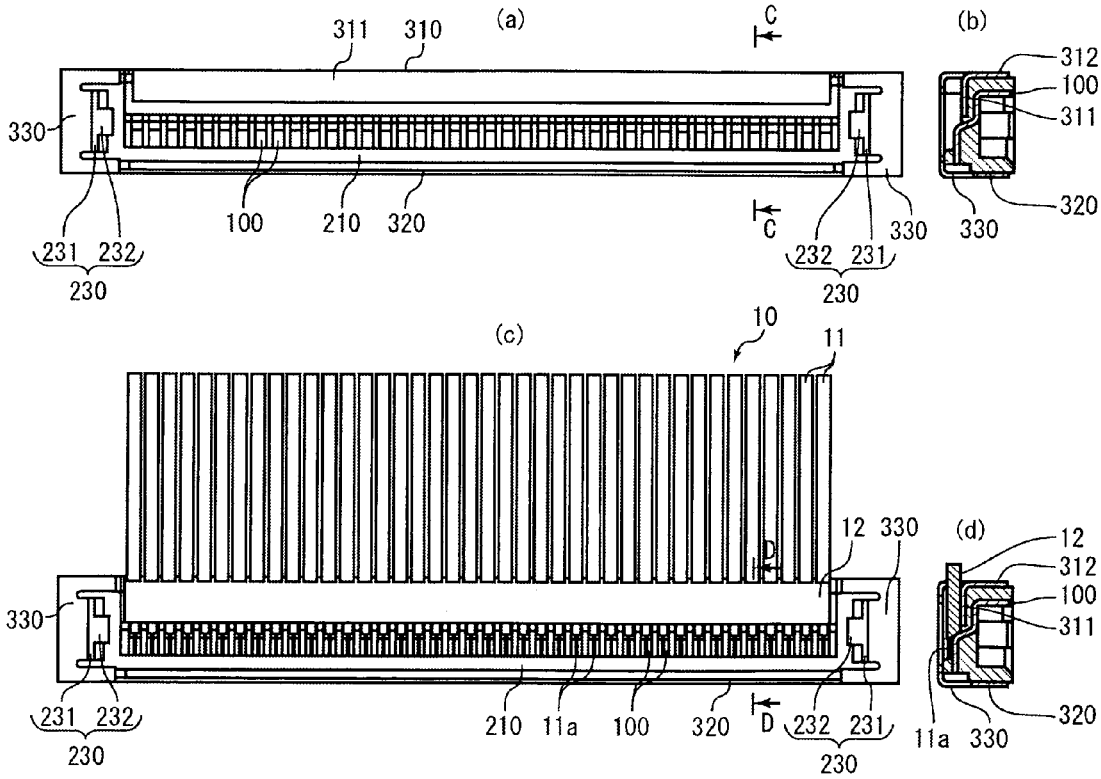
FIG. 7 is a diagram showing a cable mounting process of the connector, in which (a) is a plan view before mounting, (b) is a C-C sectional view before mounting, (c) is a plan view after mounting, and (d) is a D-D sectional view after mounting.

Hereinafter, a connector according to an embodiment of the present invention will be described with reference to the drawings. FIG. 1 is a diagram showing a used state of a connector according to the present invention, in which (a) is a plan view, and (b) is a side view. FIG. 2 is a schematic sectional perspective view showing a used state of the connector. FIG. 3 is a schematic exploded perspective vies of the connector. FIG. 4 is a diagram showing a body provided with a terminal part of the connector, in which (a) is a front view, (b) is a flat view, and (c) is an A-A sectional view. FIG. 5 is a diagram showing a shield member of the connector, in which (a) is a front view, (b) is a plan view, (c) is a bottom view, and (d) is a B-B sectional view. FIG. 6 is a diagram showing a shield cover of the connector, in which (a) is a plan view, (b) is a bottom view, (c) is a rear view, and (d) is a side view. FIG. 7 is a diagram showing a cable mounting process of the connector, in which (a) is a plan view before mounting, (b) is a C-C sectional view before mounting, (c) is a plan view after mounting and (d) is a D-D sectional view after mounting.

FIGS. 1 and 2 show is a connector for connection to a cable group 10 comprising a plurality of coaxial cables 11 which are aligned in parallel and integrated. The connector has a plurality of terminal units 100 for electrical connection to connecting conductors 11*a* of the plurality of coaxial cables 11, a body 200 in which the plurality of terminal units are aligned in a length direction, a shield member 300 attached to the body 200 and positioned between the terminal units 100 and the conductor part 12, and a shield cover 400 attached to the body 200 for sandwiching the conductor part 12 of the cable group 10 with the shield member 300.

The connector is used by being connected to a counterpart connector 20 (see FIG. 2) mounted on a substrate of an electronic device not shown. As an example, the connector is used by being connected to the both ends in a longitudinal direction of the cable group 10, and is connected to a counterpart connector mounted on a substrate of a main body side part of a portable telephone of a folding type on which key switches and the like are disposed, and to a counterpart connector mounted on a substrate of a display side part of the portable telephone on which a liquid crystal display and the like are disposed, respectively. Of course, it is also possible that the connector is used by being connected to only one end part of the cable group 10, and the other end part of the cable group 10 is connected to each part of an electronic device.

As shown in FIGS. 1 and 3, the cable group 10 is an aggregate of the coaxial cables 11. The coaxial cable 11 is well-known one in which a connecting conductor 11*a* is covered with an insulating material and a buffer material such as polyethylene, and a shielding conductor 11*b* such as a served shield or a braided shield is provided to the outside thereof, and the outside of the shielding conductor 11*b* is covered by vinyl chloride or the like.

The coaxial cable 11 has the connecting conductor 11*a* exposed by peeling vinyl chloride or the like, the shielding conductor 11*b*, and the insulating material or buffer material at the both ends of the cable in a longitudinal direction. Further, in the coaxial cable 11, the shielding conductor 11*b* is exposed by peeling the outmost vinyl chloride or the like at rearward portions of the both ends. In this state, the coaxial cables 11 are arranged in parallel, and the exposed shielding conductors 11*b* of one end side are connected by preliminary soldering collectively (the preliminary solder part forms the conductor part 12), whereby they are integrated. Note that in the case of connecting the connector to the both ends of the cable group 10, the shielding conductors 11*b* of the other end side are also connected by preliminary soldering collectively.

As shown in FIGS. 2 and 4, the body 200 is a resin product in an almost rectangle shape such as a liquid crystal polyester (LCP) resin having insulating property, and a plurality of terminal units 100 are formed by insert molding, aligned in a longitudinal direction, in the center part thereof. On one widthwise end portion of the central portion of the top surface of the body 200, a protruding vein 210 for holding the distal end portion of horizontal parts 111 of upper stages 110 of the terminal units 100 are formed in a longitudinal direction.

Further, as shown in FIGS. 3 and 4(*b*), on the longitudinal opposite end portions of the top surface of the body 200, there are provided with a pair of dented portions 220, and a pair of engaging holes 230 in a shape of projection in a plan view formed so as to communicate to the inner sides of the pair of dented portions 220. The pair of dented portions 220 receive a pair of insertion plates 340 of the shield member 300. The pair of engaging holes 230 includes a pair of first holes 231 in a rectangle shape, and a pair of second holes 232 being narrower than the first holes and being formed inside the first holes 231. The engaging holes 230 are adapted to receive the pair of engaging parts 440 of the shield cover 440.

Further, as shown in FIGS. 2 and 4(*c*), in the center part of the bottom face of the body 200, an opening 240 in a dented shape is provided for exposing a vertical part 122 of the lower stage 120 of the terminal unit 100. The counterpart connector 20 is fitted into the opening 240.

As shown in FIGS. 2 and 4(*c*), the terminal unit 100 is a conductor such as copper alloy or the like folded in a stepped shape, having the upper stage 110 and the lower stage 120.

The upper stage 110 has a horizontal part 111 (that is, the upper end of the terminal unit 100) and an inclined part 112 extending obliquely downward from the horizontal part 111. On the other hand, the lower stage 120 has a horizontal part 121 extending horizontally from the inclined part 112 and a vertical part 122 (that is, the lower end of the terminal unit 100) extending vertically from the horizontal part 121.

The inclined part 112 and the horizontal part 121 are hold portions held by the body 200. The horizontal part 111 is exposed on the top surface of the body 200, and the piece thereof is held by the protruding vein 210 of the body 200. That is, the base end part of the horizontal part 111 serves as a connecting portion with the connecting conductor 11*a* of the coaxial cable 11. The vertical part 122 is exposed from the other end side in a width direction of the opening 240, serving as a connecting portion electrically connected to a contact, not shown, of the counterpart connector 20 fitted into the opening 240.

As shown in FIGS. 3 and 5, the shield member 300 is a frame made of stainless steel, including: a first shield piece 310 in an almost reverse L shape in a sectional view; a second shield piece 320 in a long plate shape; a pair of linking parts 330 linking the both ends in a longitudinal direction of the first and second shield pieces 310 and 320; and a pair of insertion plates 340 provided downward from the pair of linking parts 330.

As shown in FIG. 2, the first shield piece 310 includes a horizontal plate 311 contacting the other widthwise end portion of the top surface of the body 200, and a vertical plate 312 continued from the horizontal plate 311 and contacting the other widthwise end face of the body 200. In a state of contacting the other widthwise end portion of the top surface of the body 200, the horizontal plate 311 is located above the lower stages 120 of the terminal units 100 with the body 200 in between. Further, on the horizontal parts 111, the conductor part 12 of the cable group 10 are mounted and connected by soldering in a state that the connecting conductors 11*a* of the coaxial cables 11 of the cable group 10 are connected to the horizontal parts 111 of the upper stages 110 of the terminal units 100. That is, the horizontal plate 311 serves as a portion positioned between the lower stages 120 of the terminal units 100 mid the conductor parts 12 of the cable group 10.

The second shield piece 320 faces the vertical plate 312 of the first shield piece 310, contacting the lower part of one end widthwise face of the body 200.

The pair of insertion plates 340 are inserted into the pair of dented parts 220 of the body 200, and positioned on the both sides of the center part (that is, terminal unit 100 arranging area) of the body 200. Thereby, the shield member 300 is mounted to the body 200, and the respective parts of the shield member 300 contact the respective parts of the body 200 as described above.

As shown in FIGS. 3 and 6, the shield cover 400 is a part made of stainless steel, including: a main body part 410 in a long plate shape; a front surface part 420 in a long plate shape provided downward from one widthwise end of the main body part 410; four piece members 430 provided with prescribed intervals on the other widthwise end part of the main body 410; and four engaging parts 440 provided downward from the both longitudinal ends of the main body part 410.

As shown in FIG. 2, the main body part 410 is mounted on the protruding vein 210 of the body 200, covering one end part in a length direction of the coaxial cables 11 of the cable group 10 connected to the top surface of the body 200 and the terminal unit 100. The piece members 430 contact the top surface of the conductor part 12 of the cable group 10 together with a part of the other end part in a width direction of the main body part 410, in a state where the main body part 410 covers one end part in a length direction of the coaxial cables 11 of the cable group 10, and are connected by soldering. In the piece member 430, the both end parts are folded downward, and in a state of contacting the conductor part 12, press the conductor part 12 toward the horizontal plate 311 of the first shield piece 310 of the shield member 300. This provides a stable electric connection of the conductor part 12, the shield member 300 and the shield cover 400.

The front face part 420 covers the front side (that is, one end side in a horizontal direction of the body 200) of the protruding vein 210 of the body 200 and the top side part of one side face in a width direction of the body 200.

As shown in FIG. 6, the engaging part 440 has a press-insertion plate 441 to be press-inserted into the first hole 231 of the engaging hole 230 of the body 200, and an engaging pawl 442 provided downward from the press-insertion plate 441.

The press-inserted plate 441 is provided with a pair of protrusions 441*a* on the both end parts in a width direction. Thereby, the width dimension of the press-insertion plate 441 is slightly larger than the length dimension of the first hole 231 of the engaging hole 230 of the body 200. In this way, the press-insertion plate 441 is made to be able to be press-inserted into the first hole 231 of the engaging hole 230 of the body 200. The protrusions 441*a* are inclined downward so as to make the press-insertion plate 441 to be easily press-inserted into the engaging hole 230.

Further, the press-insertion plate 441 is provided with a pair of flared parts 441*b* flaring toward the inner side. The pair of flared parts 441*b* contacts the inner wall face inside the first hole 231 of the engaging hole 230. Thereby, the shield cover 400 prevents rattle in a mounted state. Further, when the pair of flared parts 441*b* contacts the inner wall face of the first hole 231 of the engaging hole 230, the outer surface of the press-insertion plate 441 contacts the insertion plate 340 of the shield member 300 inserted in the dented part 220 in the outside of the engaging hole 230. In this way, since the press-insertion plate 441 presses the insertion plate 340 of the shield member 300 in between it and the inner wall face of the outside of the dented part 220, rattle of the shield member 300 is prevented.

The engaging pawl 442 is fitted into the first and second holes 231 and 232 of the engaging hole 230 of the body 200. In this state, the tip part of the engaging pawl 442 slightly protrudes from the bottom face of the body 200. That is, the engaging pawl 442 serves as a connecting portion connected to the ground line of the substrate of the electronic device.

Hereinafter, steps of assembling such a connector (including a connecting step of the cable group 10) will be described. First, the pair of insertion plates 340 of the shield member 300 are inserted into the pair of dented parts 220 of the body 200 in which the terminal part 100 is formed by insertion molding. Then, as shown in FIG. 7, (a) and (b), the first shield piece 310 of the shield member 300 contacts and extends along the other widthwise end portion of the top surface and the other end widthwise face of the body 200. On the other hand, the second shield piece 320 of the shield member 300 contacts and extend along the lower side part of one widthwise end face the body 200.

Then, as shown in FIG. 7, (c) and (d), the connecting conductors 11*a* of the coaxial cables 11 of the cable group 10 are mounted on the base end part (exposed part) of the horizontal part 111 of the upper stage 110 of the terminal unit 100, and the conductor part 12 of the cable group 10 is mounted on the horizontal plate 311 of the first shield piece 310 of the shield member 300. In this state, the connecting conductor 11*a* is connected by soldering to the horizontal part 111 of the terminal unit 100, and the conductor 12 is connected by soldering to the horizontal plate 311 of the shield member 300.

Then, the pair of engaging parts 440 of the shield cover 400 are inserted in and engaged with the pair of engaging holes 230 of the body 200. Then, the main body part 410 of the shield cover 400 is mounted on the protruding vein 210 of the body 200 so as to cover one end part in a length direction of the coaxial cables 11 of the cable group 10 connected to the top surface of the body 200 and the terminal unit 100, and a part of the other end part in a width direction of the main body part 410 of the shield cover 400 and the piece member 430 are mounted on the conductor part 12 of the cable group 10. Further, together with it, the front surface part 420 of the shield cover 400 covers the front side of the protruding vein 210 of the body 200 and the upper side part of one side face in a width direction of the body 200.

In the opening 240 of the body 200 of the connector assembled in this manner, the counterpart connector 20 mounted on the substrate of the electronic device is fitted. Then, the contact of the counterpart connector 20 contacts the vertical part 122 of the lower stage 120 of the terminal unit 100 exposed from the opening 240 of the body 200, whereby the both are electrically connected. At this time, the engaging pawls 442 of the pair of engaging parts 440 of the shield cover 400 protruding from the bottom face of the body 200 contact the ground line of the substrate of the electronic device, and are electrically connected.

In the case of such a connector, the conductor part 12 of the cable group 10 is adapted to be connected by soldering to the first shield piece 310 of the shield member 300 and the piece member 430 of the shield cover 400, so a ground bar is not needed like the conventional example. Therefore, the cost of parts and the assembling cost of the ground bar can be reduced, so that a lower cost can be realized. Further, since the ground bar is not needed, the height of the device can be reduced.

Moreover, the both ends in a width direction and the upper surface of the body 200 can be shielded by the shield member 300 and the shield cover 400, and the both sides in a length direction of the center part (that is, the arrangement area of the terminal unit 100) of the body 200 can be shielded by the pair of insertion plates 340 of the shield member 300 and the pair of engaging units 440 of the shield cover 400. Therefore, it is possible to interrupt signals leaked from the shielding conductor 11*b* of the cable group 10 so as not to affect the respective parts of the electronic device on which the connector is mounted. Further, the first shield piece 310 of the shield member 300 is positioned between the lower stage 120 of the terminal unit 100 and the conductor part 12 of the cable group 10, so signals leaked from the shielding conductor 11*b* of the cable group 10 can be shielded so as not to affect the adjacent terminal unit 100, whereby crosstalk can be reduced. Therefore, the connector can have higher shielding property compared with the conventional example.

Further, since both of the shield member 300 and the shield cover 400 are connected by soldering to the conductor part 12 of the cable group 10, the holding force of the cable group 10 can be improved compared with the conventional example in which only a shield cover is connected by soldering. Therefore, even if the cable group 10 is pulled upward, it is possible to prevent disconnection or solder separation in the solder-connected part between the connecting conductors 11*a* of the coaxial cables 11 of the cable group 10 and the terminal unit 100.

Note that the body 200 of the connector may be of any kind as long as it has insulating property and allows attachment of a plurality of terminal units 100 aligned in parallel.

For the terminal unit 100, anything having conductivity can be used. For the shape of the terminal unit 100, the design may be changed in any way if it can be connected to the connecting conductors 11*a* of the coaxial cables 11 of the cable group 10 and can be connected to the substrate of the electronic device.

For the shield member 300, it is desirable to have the first and second shield pieces 310 and 320 in order to improve the shielding property, but it is acceptable if the member includes at least the first shield piece 310. Although the shield member 300 has been described to be mounted to the body 200, it may be integrally provided to the body with the terminal unit 100.

For the shield cover 400, it is desirable to be adapted to cover the top face of the body 200, but anything may be used if it can sandwich the conductor part 12 of the cable group 10, together with the shield member 300, in between them. Therefore, it is optional whether to provide the piece member 430 or not.

Further, it is desirable that either the shield member 300 or the shield cover 400 be connected by soldering to the conductor part 12 of the cable group 10. However, if a prescribed holding force can be provided by being sandwiched by the shield member 300 and the shield cover 400 in between them, the connection by soldering is not required.

Note that the connector is not only used for the coaxial cables 11 but may also be used for cables having connecting conductors and shielding conductors. Some exaples of such cablesare are twin cables and twist pair cables. Further, the connector is also possible to be used for cables having a plurality of cables with the connecting conductors 11*a* and being shielded collectively.

As to the electronic device, it is needless to say that the present invention can be used for not only a portable telephone described above, but also a portable mobile terminal device such as PDA, a digital camera, a digital video camera, a personal computer, and other electronic devices.

What is claimed is:

1. A connector for connection to a cable group comprising a plurality of cables, the cables being integrated by aligning the cables in parallel and connecting shielding conductors thereof to a conductor part, the connector comprising:

a plurality of terminal units having first and second ends, the first ends having electrical connection to connecting conductors of the plurality of cables;

a body having an insulating property in which the plurality of terminal units are aligned in a length direction;

an electrically conductive shield member mountable to the body so as to be disposed above the second ends of the plurality of terminal units and contact a lower surface of the conductor part; and an electrically conductive shield cover attachable to the body for contacting an upper surface of the conductor part and sandwiching the conductor part with the shield member.

2. The connector according to claim 1, wherein at least one of the shield member and the shield cover is connected to the conductor part by soldering.

3. The connector according to claim 2 in which the shield cover is connected by soldering to the conductor part of the cable group, wherein the portion of the shield cover contacting the conductor part is provided with a piece member for connecting by soldering to the conductor part.

4. A connector for connection to a cable group comprising a plurality of cables, the cables being aligned in parallel and shielded collectively with a shielding conductor, the shielding conductor connected to a conductor part, the connector comprising:

a plurality of terminal units having first and second ends, the first ends having electrical connection to connecting conductors of the plurality of cables;

a body having insulating property in which the plurality of terminal units are aligned in a length direction;

an electrically conductive shield member mountable to the body so as to be disposed above the second ends of the plurality of terminal units and contact a lower surface of the conductor part; and an electrically conductive shield cover attachable to the body for contacting an upper surface of the conductor part and sandwiching the conductor part with the shield member.

5. The connector according to claim 4, wherein at least one of the shield member and the shield cover is connected to the conductor part by soldering.

6. The connector according to claim 5 in which the shield cover is connected by soldering to the conductor part of the cable group, wherein the portion of the shield cover contacting the conductor part is provided with a piece member for connecting by soldering to the conductor part.

7. A connector for connection to a cable group comprising a plurality of cables, the cables being integrated by aligning the cables in parallel and connecting shielding conductors thereof to a conductor part, the connector comprising:

a plurality of terminal units for electrical connection to connecting conductors of the plurality of cables;

a body having an insulating properly in which the plurality of terminal units are aligned in a length direction;

a shield member mountable to the body and positioned between the plurality of terminal units and the conductor part; and a shield cover attachable to the body for sandwiching the conductor part with the shield member, wherein the terminal units respectively comprise top end parts and bottom end parts, the top end parts being exposed from one widthwise end portion of a top surface of the body so as to be connectable to the connecting conductors of the cables, while bottom end parts being exposed from the other widthwise end portion of a bottom surface of the body, and wherein the shield member serving as a frame and being mountable to the body includes: a first shield piece having an almost inverted L shape in a cross-sectional view and extending along the other widthwise end portion of the top surface of the body and the other widthwise end face of the body; and a second shield piece extending along the one widthwise and face of the body, and the portion of the first shield piece contacting the top surface of the body is contactable with the conductor part.

8. An electronic device comprising the connector according to one of claims 1-6.

9. An electronic device comprising the connector according to claim 7.

* * * * *